US005228252A

United States Patent [19]

Nehls

[11] Patent Number: 5,228,252

[45] Date of Patent: Jul. 20, 1993

[54] FLOOR PANEL USED IN RAISED FLOORING WITH INTERLOCKING DOMES

[75] Inventor: Charles O. Nehls, Allen Park, Mich.

[73] Assignee: Unistrut International Corp., Ann Arbor, Mich.

[21] Appl. No.: 815,990

[22] Filed: Jan. 2, 1992

[51] Int. Cl.[5] ..... E04B 9/00

[52] U.S. Cl. ..... 52/126.6; 52/792; 52/263

[58] Field of Search ..... 52/126.6, 792, 263

[56] References Cited

U.S. PATENT DOCUMENTS 1,784,511 12/1930 Carns ..... 52/792 X
3,196,763 7/1965 Rushton .
3,461,632 8/1969 Kuhne ..... 52/792 X
3,834,487 9/1974 Hale ..... 52/792 X
3,938,963 2/1976 Hale ..... 52/792 X
4,411,121 10/1983 Blacklin .
4,753,058 6/1988 Ray, III .
4,889,758 12/1989 Rinkewich ..... 52/792 X
5,046,291 9/1991 Narayan .
5,115,621 5/1992 Kobayashi ..... 52/792 X

*Primary Examiner*—Richard E. Chilcot, Jr.
*Assistant Examiner*—Beth A. Aubrey
*Attorney, Agent, or Firm*—Dykema Gossett

[57] ABSTRACT

An elevated flooring system including a plurality of panels supported above a base floor is disclosed. Each panel is constructed of a substantially flat upper member and a lower member which includes a plurality of interconnected hemispherical domes. A dome pole directly contacts and supports the upper member. Each dome is interconnected to at least two other domes by a connecting rib. The plurality of ribs creates an internal rigid structure which provides additional support and stability within the floor panel.

20 Claims, 2 Drawing Sheets

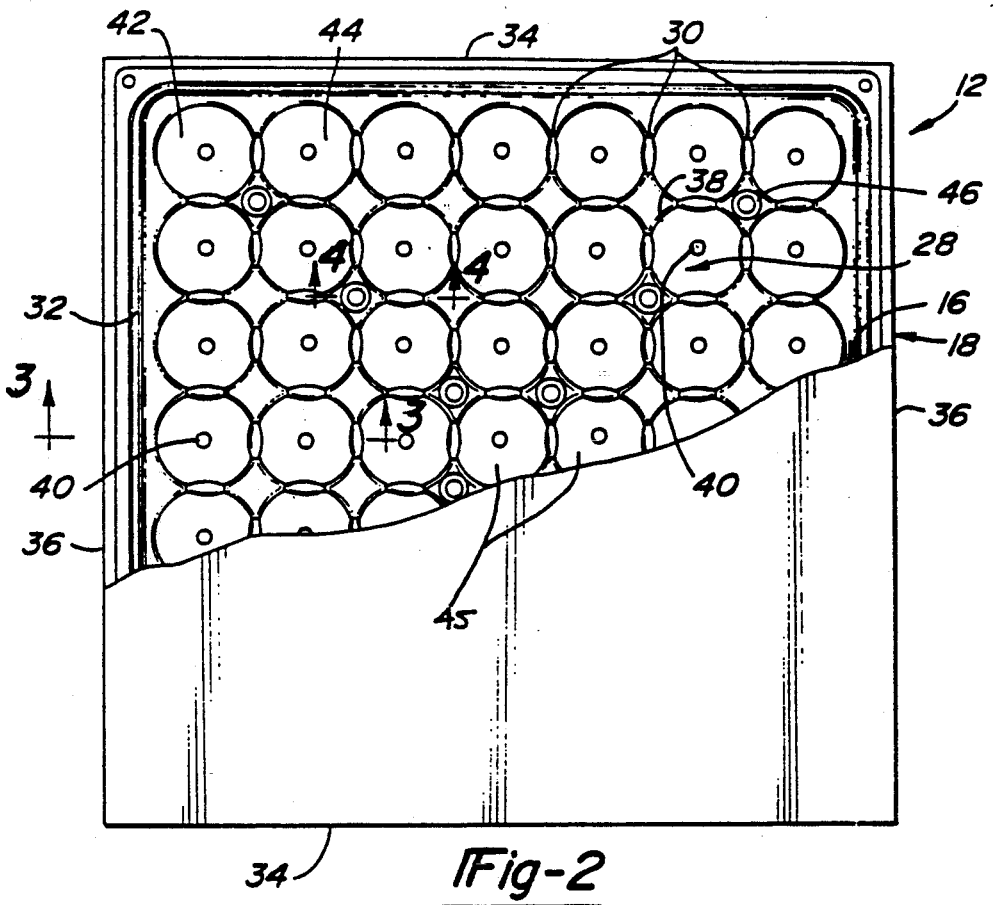
Fig-2
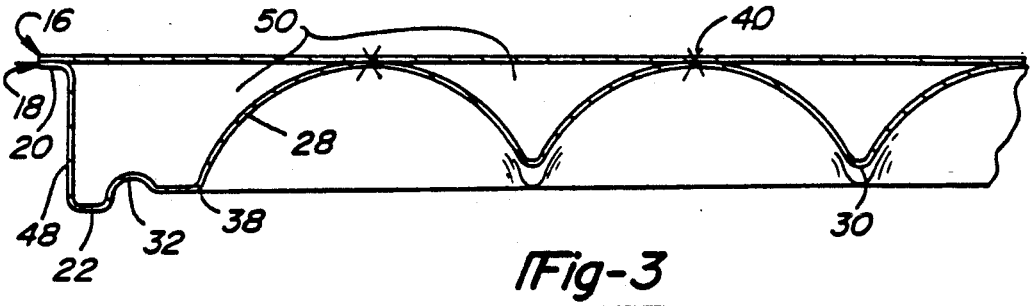
Fig-3
Fig-4
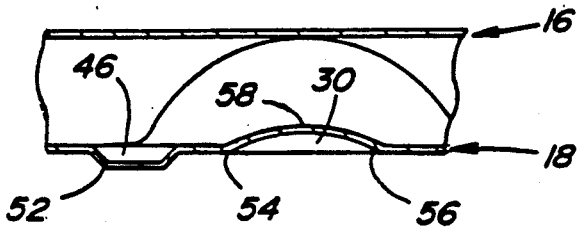

FLOOR PANEL USED IN RAISED FLOORING WITH INTERLOCKING DOMES

BACKGROUND OF THE INVENTION

This application relates to an improved floor panel for use in a raised flooring system.

Raised flooring systems are often used in installations where wires, pipes, conduit or any other type of cable must be concealed, but still remain easily accessible. A common application of a raised flooring system is in conjunction with a computer room. A computer room will typically house a plurality of computers and associated peripheral devices which are connected through a large number of cables. Raised flooring systems conceal these cables, while still allowing access them.

One common type of raised flooring system includes an upper floor, which is constructed above and supported by a base floor. The upper floor usually includes a plurality of structural panel elements which are supported above the base floor by pedestals.

One well-known type of floor panel for raised flooring systems includes an upper member which defines a floor face and a lower member which supports the upper member. The lower member will typically have a plurality of hemispherical domes which extend vertically towards the upper member, and which contact and support the upper member. A plurality of pedestals are positioned at the corners of the floor panels to support the lower member above the base floor.

The known prior art panels have proven somewhat successful in achieving the goals of concealing the cables. There are some deficiencies in their construction, however, in that the strength of the individual panels is less than is desired. Some of the prior art floor panels are also difficult or costly to manufacture.

SUMMARY OF THE INVENTION

The present invention discloses a structural floor panel which is simple in construction, easy to manufacture, and which also exhibits superior load bearing characteristics.

In a disclosed embodiment, the floor panel is square and formed of two structural elements. A first, or upper member is substantially flat and supported by a second, or lower member. The lower member has a plurality of hemispherical domes which have poles in contact with the upper member. The domes are interconnected to other domes by connecting ribs which form a support matrix providing internal rigidity. In a preferred embodiment, the domes are arranged in a pattern on the second member which ensures increased strength over the prior art floor panels.

In further preferred features of the present invention, the ribs are each preferably arched upwardly towards the upper member from ends of the ribs. In this way the ribs provide additional support.

In further features of the present invention, depressions are spaced between spaces formed between adjacent domes. The depressions provide support surfaces to receive the pedestals should the floor panel be cut. Preferably, the depressions are formed in spaces which extend along lines between non-adjacent corners of the floor panels such that the depressions form a cross within the pattern of the domes.

These and other aspects of this invention are illustrated in the accompanying drawings and are more fully described in the following specification.

BRIEF DESCRIPTION OF DRAWINGS

FIG. 2 is a plan view of a flooring panel used in the raised flooring system of FIG. 1.

FIG. 3 is a partial cross-sectional view taken substantially along line 3—3 of FIG. 2.

FIG. 4 is a partial cross-sectional view taken substantially along line 4—4 of FIG. 2.

DESCRIPTION OF THE PREFERRED EMBODIMENT

Figure 1:
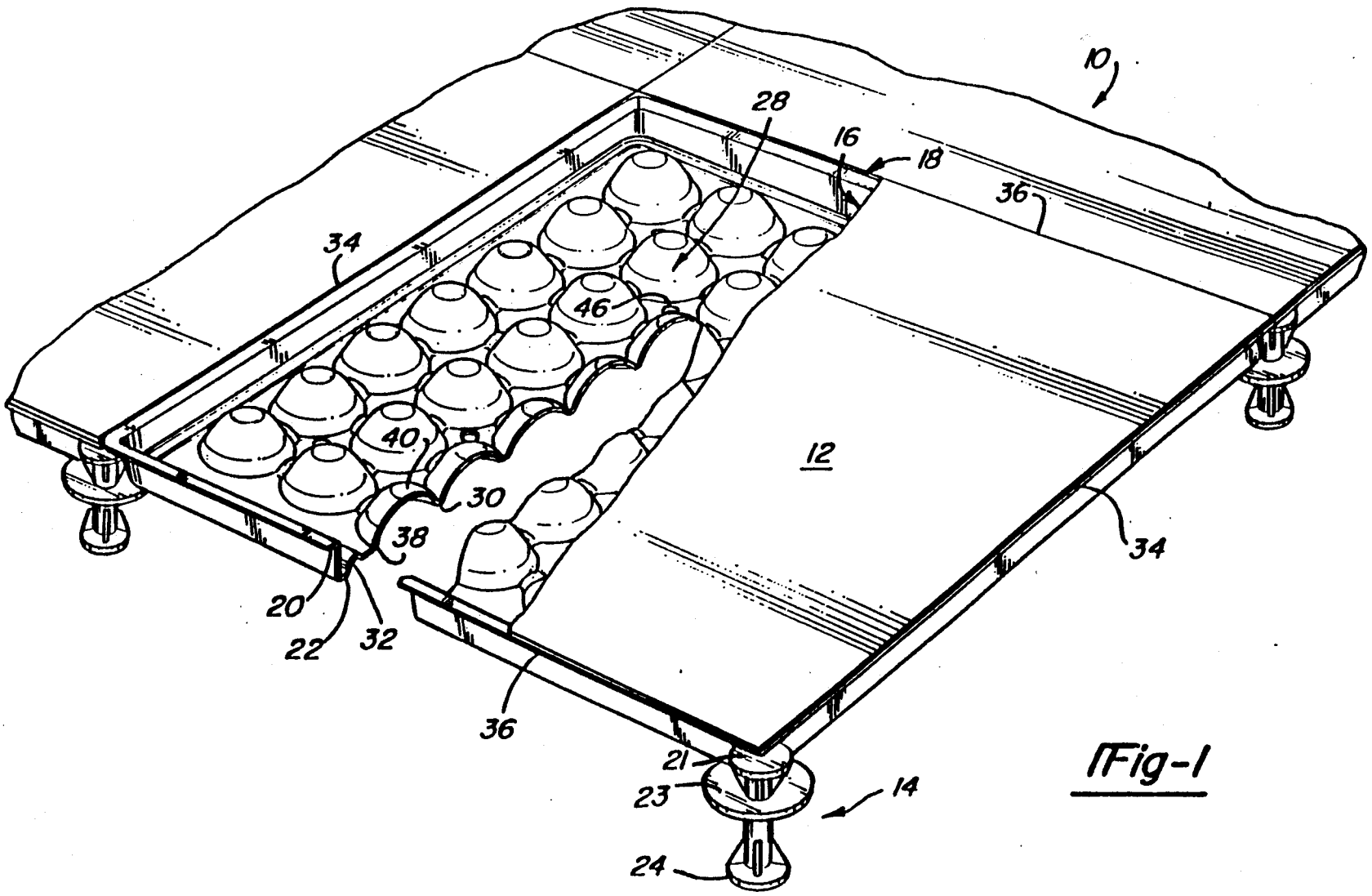
FIG. 1 is a perspective view of a raised flooring system.

Referring to the drawings, FIG. 1 shows a raised flooring system 10 which includes a plurality of floor panels 12 which are supported at their corners by pedestals 14, and assembled in an array spaced above a base floor of a room. The use of pedestals 14 in conjunction with floor panels 12 provides an elevated floor whereby cables, pipes, conduit and the like can be routed underneath the raised flooring system 10 while remaining easily accessible.

Floor panel 12 consists of a substantially flat and rectangular upper member 16 and a lower member 18 designed to transfer the load upon the upper member 16. The design of the pedestals 14 which support the raised floor are not critical to the invention, and several types are in common usage. An outwardly flanged end 20 of a floor panel 12 is supported at an upper platform 21 on pedestals 14. A mount surface 22 on lower member 18 is supported on an intermediate platform 23 on pedestal 14. A lower platform 24 of each pedestal 14 rests on the base floor. Each pedestal 14 is separately adjustable in length so that it may compensate for any variations in the actual level of the base floor relative to a nominal level. The spacing of pedestals 14 correspond to the side dimensions of floor panels 12.

Lower member 18 includes a pattern of hemispherically-shaped domes 28. Each dome 28 is interconnected to at least two adjacent domes 28 at a rib 30. The plurality of ribs 30 form a rigid matrix structure within the floor panel 12. In addition, a strengthening ridge 32 extends along the longitudinal sides 34 and the lateral sides 36 of lower member 18.

As shown in FIG. 2, each dome 28 extends from a dome root 38, which is substantially circular in plan view, upwardly to dome pole 40 which contacts upper member 16. Domes 28 are arranged in an array of rows, such that there are corner domes 42, periphery domes 44, and central domes 45. A corner dome 42 is located at each corner of floor panel 12 and is interconnected to two adjacent domes 28 by ribs 30 spaced 90° from each other. Periphery domes 44 are located around the longitudinal edges 34 and lateral edges 36 of the floor panel 12, and are interconnected to three adjacent domes 28 by ribs 30 spaced 90° from each other. Central domes 45 are located longitudinally and laterally inwardly of the periphery domes 44 and are interconnected by ribs 30 to four adjacent domes 28 spaced 90° from each other. The plurality of ribs 30 form a support matrix within the floor panel 12, providing additional rigidity.

Depressions 46 are formed in areas between domes 28. As shown, depressions 46 are formed in spaces which extend from non-adjacent corners of the panel 12, forming a cross shape on lower member 18. Depressions 46 extend downwardly to the same vertical elevation as mount surface 22, which extends along the outer periphery, and is the lowermost part of floor panel 12. During installation of a raised flooring system 10, floor panels 12 may be cut or trimmed to fit the dimensions of a given room. In the event a floor panel 12 is cut, depressions 46 provide an area which is at the same vertical elevation as mount surface 22, such that it provides a surface to be supported by a pedestal 14.

As shown in FIG. 3, upper member 16 is supported primarily by domes 28. Domes 28 are substantially the same height, thereby providing a uniformly flat contact surface for upper member 16. Dome poles 40 are preferably fastened to upper member 16 by some means, spot welding being the preferred method.

A substantially vertical side wall 48 is formed at the perimeter of lower member 18 and terminates at an outwardly flanged end 20. Flanged end 20 supports the periphery of upper member 16. The vertical side wall 48 is preferably integral to lower member 18. As shown, strengthening ridge 32 has an arc shape in cross-section. Ridge 32 provides resistance to warping or buckling of panel 12 by twisting forces.

A cavity 50 defined by upper member 16 and lower member 18 may either remain unfilled, or be filled with some type of material before the upper member 16 is welded in place. The fill material may be foam, plaster, rubber, lightweight cementitious material or any other suitable material. Such material provides the floor panel 12 with additional rigidity and further supports upper member 16. In addition, the fill material provides sound deadening characteristics.

FIG. 4 is a cross-sectional view of a depression 46 and a rib 30 formed in lower member 18. Depression 46 extends vertically downwardly to a location 52 aligned with the lowermost elevation of the floor panel 12, which is the mount surface 22.

Rib 30 is arc-shaped in cross-section. The arc shape of the rib 30 is a function of the hemispherical shape of a dome 28 at the area of contact with an adjacent dome. The cross-section of the rib 30 has two ends 54 and 56, which are vertically aligned with dome root 38. Rib 30 extends from ends 54 and 56 upwardly toward an uppermost central portion 58 of the rib 30. The arc shape of rib 30 provides resistance to warping or buckling caused by twisting forces.

Upper member 16 and lower member 18 are preferably constructed from sheet metal, although other material such as plastic, fiberglass, or the like could be substituted. In one embodiment, the upper member 16 was 0.060 inches thick and formed of SAE1045 full hard steel. The steel was preferably high carbon, cold rolled hard untampered quality with a matte finish. The lower member 18 was 0.048 inches thick and formed of SAE1006 steel of drawing quality which was hot rolled.

Preferred embodiments of the present invention have been disclosed. A worker of ordinary skill in the art, however, will recognize that certain modifications would come within the scope of this invention For that the reason the following claims should be studied in order to determine the true scope and content of this invention.

I claim:

1. A panel for use in supporting loads comprising:

a substantially flat first member having an inner face and an outer face, said inner and said outer faces extending along generally parallel planes;

a second member formed from a single planar sheet of metal, and disposed generally parallel to said first member and spaced from said inner face in a first direction, said second member having a plurality of generally hemispherical domes formed therein, each said dome having a pole in contact with said inner face of said first member, and extending in said first direction from said pole to a dome root, and wherein a connection portion of said domes intermediate said dome root and said pole is connected to a portion of at least two other said domes, said connection portion being over a limited extent and being spaced from said pole along said first direction; and the generally hemispherical shape of said domes extends in said first direction to a dome root extending about said pole for the majority of 360 degrees, said dome roots not being formed at locations where said domes are interconnected to adjacent domes.

2. The panel as recited in claim 1, wherein said second member includes integral side walls at an outer periphery, said side walls extending from a mount surface, which is a portion of said second member spaced furthest from said first member in a direction opposite to said first direction to outwardly flanged needs, said outwardly flanged ends contacting and supporting said inner face of said first member about an outer periphery of said first member.

3. The panel as recited in claim 1, wherein each said dome is fastened to said first member at said pole, each said pole located at an apex of the generally hemispherical shape, and each said pole adapted to transfer a load from said first member to said second member.

4. A panel for use in supporting loads comprising:

a substantially flat first member having an inner face and an outer face, said inner and said outer faces extending along generally parallel planes;

a second member generally parallel to said first member and spaced from said inner face in a first direction, said second member having a plurality of generally hemispherical domes formed therein, each said dome having a pole in contact with said inner face of said first member, and extending in said first direction from said pole to a dome root, and wherein a portion of said domes intermediate said dome root and said pole is connected to a portion of at least two other said domes; and each said dome extends towards said first member from a dome root and said domes being connected by ribs.

5. The panel as recited in claim 4, wherein said dome roots of adjacent domes are spaced by a small distance, and said ribs extend across said small distance.

6. The panel as recited in claim 4, wherein a rib cross-section defined in a plane perpendicular to a line extending between the poles of adjacent domes interconnected by said rib, has a curved shape with two ends, wherein said ends are at a first distance from said first member, said ribs being curved towards said first member between said ends, such that an intermediate portion of said ribs is spaced from said first member by a second distance, which is less than said first distance.

7. The panel as recited in claim 4, wherein said domes are interconnected by ribs, said ribs forming a support matrix to provide internal rigidity.

8. A rectangular panel for use in supporting loads comprising:

a substantially flat rectangular first member having an inner face and an outer face, said inner and said outer faces extending along generally parallel planes;

a rectangular second member generally parallel to said first member and spaced in a first direction from said inner face, said second member having a pair of longitudinal edges, a pair of lateral edges, and four corners at the intersection of each said longitudinal edge and each said lateral edge; and a plurality of domes formed in said second member and extending in a second direction opposite to said first direction form a dome root to a pole in contact with said first member, corner domes being defined at each said corner of said second member, each said corner dome interconnected to two other domes spaced 90 degrees about said pole, periphery domes being defined along each said longitudinal and lateral edge of said second member, each said periphery dome interconnected to three other said domes spaced 90 degrees about said pole, and central domes being defined longitudinally and laterally inwardly of said periphery domes, each said central dome interconnected to four other domes spaced 90 degrees about said pole;

said domes are interconnected by ribs, said ribs forming a support matrix to provide internal rigidity.

9. The panel as recited in claim 8, wherein said second member has mount surfaces about an outer periphery, said mount surfaces being at a first distance from said first member, said dome roots being at a second distance from said first member, said second distance being less than said first distance.

10. The panel as recited in claim 9, wherein said second member includes a plurality of depressions formed in areas between said dome roots, and extending to locations spaced from said first member by said first distance.

11. The panel as recited in claim 10, wherein the depressions are arranged such that a pair of lines drawn between the non-adjacent corners of said second member passes through each of said depressions.

12. The panel as recited in claim 10, wherein said depressions are spaced between four adjacent domes, said depressions being spaced throughout said second member in such a manner as to form a cross shape extending between non-adjacent corners.

13. The panel as recited in claim 9, wherein said second member includes integral side walls about an outer periphery, said side walls extending in a direction opposite to said first direction from said mount surfaces to outwardly flanged ends contacting and supporting said inner face of said first member about an outer periphery of said first member.

14. The panel as recited in claim 8, wherein said second member has a strengthening ridge extending parallel to said longitudinal and lateral edges, said strengthening ridge being integral to said panel and located longitudinally and laterally inwardly of outer periphery of second member and having an arc shaped cross-section.

15. The panel as recited in claim 8, wherein said dome roots are spaced from said first member by a second distance, said domes being interconnected by ribs which are generally spaced from said first member by a third distance, which is less than said second distance.

16. The panel as recited in claim 15, wherein a rib cross-section defined in a plane perpendicular to a line extending between the poles of adjacent domes interconnected by said rib, has a curved shape with two ends, said ends being at fourth distance from said first member, said ribs being curved towards said first member between said ends, such that an intermediate portion of said ribs is spaced from said first member by a fifth distance, which is less than said fourth distance.

17. The floor panel as recited in claim 16, wherein said second distance is approximately equal to said fourth distance.

18. An elevated floor system comprising:

a plurality of connected rectangular floor panels, each said floor panel having a substantially flat top surface formed from a first member and a bottom surface formed of a second member spaced vertically downwardly from said first member, said second member having a plurality of generally hemispherical domes extending from a dome root vertically toward said first member and having a pole in contact with said first member, said domes being interconnected to at least two other said domes by ribs vertically intermediate said dome root and said first member; and support members supporting said panels above the ground.

19. The floor panel as recited in claim 18, wherein said second member includes integral vertical side walls about an outer periphery, said side walls extending vertically upwardly from a first vertical location at a lowermost portion of said second member and terminating in outwardly flanged ends, said flanged ends contacting and supporting an outer periphery of said first member.

20. The floor panel as recited in claim 18, wherein said ribs extend between two ends, with said rib being arched upwardly, such that said rib ends are spaced vertically downwardly from a central rib portion.

* * * * *